United States Patent [19]

Kannegiesser

[11] 4,325,324

[45] Apr. 20, 1982

[54] APPARATUS FOR STIFFENING TEXTILE SHEETS BY COATING WITH PLASTIC

[75] Inventor: Martin Kannegiesser, Bad Salzuflen, Fed. Rep. of Germany

[73] Assignee: Herbert Kannegiesser GmbH & Co., Vlotho, Fed. Rep. of Germany

[21] Appl. No.: 155,727

[22] Filed: Jun. 2, 1980

[30] Foreign Application Priority Data

Jun. 2, 1979 [DE] Fed. Rep. of Germany ..... 2922613
Jun. 2, 1979 [DE] Fed. Rep. of Germany ..... 7916050

[51] Int. Cl.[3] ..... B05C 1/02
[52] U.S. Cl. ..... 118/642; 118/212; 118/239; 118/249
[58] Field of Search ..... 118/239, DIG. 4, 324, 118/249, 250, 212, 642, 221

[56] References Cited

U.S. PATENT DOCUMENTS

| | | | |
|---|---|---|---|
| 2,614,522 | 10/1952 | Snyder | 118/249 X |
| 3,074,374 | 1/1963 | Burkle | 118/DIG. 4 |
| 3,659,554 | 5/1972 | Friz et al. | 118/DIG. 4 |
| 3,802,387 | 4/1974 | Perry et al. | 118/324 |
| 4,173,199 | 11/1979 | Fassina | 118/212 |

FOREIGN PATENT DOCUMENTS 76648 7/1977 Luxembourg .

*Primary Examiner*—John P. McIntosh
*Attorney, Agent, or Firm*—Sughrue, Mion, Zinn, Macpeak and Seas

[57] ABSTRACT

An apparatus for stiffening textile pieces 10 by coating them with plastic includes a printing or coating cylinder 16 and underlying pressure roller 18, and a subsequent tunnel dryer 42. The pieces are fed through the printing and drying stations by separate conveyor belt mechanisms 13, 14, 15 longitudinally movable away from the printing station to enable easy access thereto for cleaning and servicing.

9 Claims, 4 Drawing Figures

APPARATUS FOR STIFFENING TEXTILE SHEETS BY COATING WITH PLASTIC

BACKGROUND OF THE INVENTION

The invention relates to an apparatus for stiffening textile sheets of various shapes for the manufacture of garments by coating them with plastic, especially for the stiffening of outer fabrics, said apparatus consisting of a device for coating the textile sheets and a device for the subsequent heat treatment thereof as well as a belt-shaped conveyor mechanism for conveying the textile sheets through these devices, the coating device having a printing unit with a printing cylinder arranged above a pressure roller and the heat treatment device having a tunnel dryer.

With a known apparatus (German Offenlegungsschrift No. 2,552,878, FIG. 3) the belt-shaped conveyor mechanism is subdivided transversely to its conveying direction before the heat treatment device. In practice, two conveyor belts are present, the conveyor belt of the coating device being considerably drawn forward and extended in the conveying plane, respectively before and after the printing cylinder and pressure roller, for the purpose of forming a feed station. The conveyor belt of the coating device is furthermore in one piece and is guided over the pressure roller with its upper strand. The pressure roller and printing cylinder are thus pressable on one another only with the inclusion of the conveyor belt. For cleaning the remains of plastic and the like from the conveyor belt, a washing bath is provided for said belt at the end thereof. A disadvantage with this apparatus is that owing to the above-mentioned construction it requires frequent servicing and cleaning.

SUMMARY OF THE INVENTION

The object of this invention is to provide an apparatus of the above-mentioned type which is substantially easier and quicker to service, especially to clean, than the known apparatus.

Due to the special subdivision according to the invention of the conveyor mechanism transversely to its conveying direction into several movable units, the apparatus can be serviced, especially cleaned, substantially more easily and more quickly than the known apparatus. Said subdivision of the conveyor mechanism enables it to be moved away from the pressure roller and printing cylinder, so that these parts and the conveyor mechanism itself are substantially more accessible. Thus, for example, the pressure roller and printing cylinder are freely accessible on their longitudinal sides after the conveyor mechanism units placed before and after same have been moved away.

Figure 1:
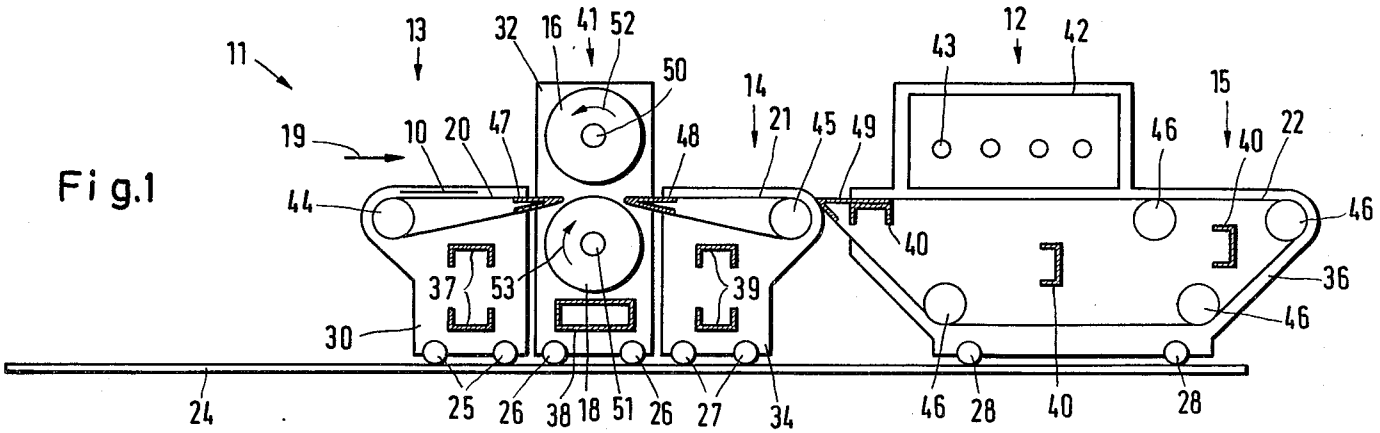
FIG. 1 is a longitudinal section through the apparatus.
Figure 2:
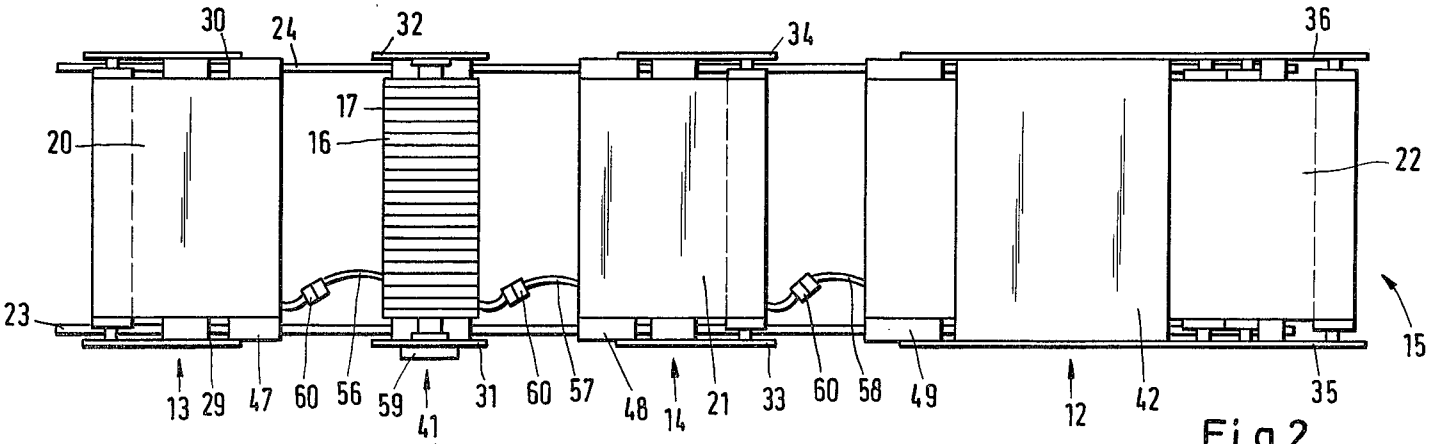
FIG. 2 is a plan view of the apparatus according to FIG. 1, but in which the units of the conveyor mechanism and the printing unit are moved away from one another.

The apparatus illustrated in FIGS. 1 and 2 consists of a coating device 11, a heat treatment device 12 and a conveyor mechanism subdivided into units 13, 14, 15 for conveying textile sheets 10 to be coated through the devices 11, 12. The coating device 11 has a printing unit 41 with printing cylinder 16 and pressure roller 18. The printing cylinder 16 has radial grooves 17 for receiving the plastic to be transferred onto the textile sheets. The plastic is fed to the grooves 17 by devices not illustrated and known per se. The printing cylinder 16 and the pressure roller 18 are arranged between side walls 31, 32 connected by crossbars 38 and are mounted in an appropriate form on said walls by means of axles 50, 51. The printing cylinder 16 and the pressure roller 18 are driven in the direction of arrows 52, 53 by electrical drives not illustrated and known per se, such as, for example, geared motors. The device 12 for the heat treatment of textile sheets which have been coated by the device 11 has a tunnel dryer 42 with infra-red lamps 43. The tunnel dryer 42 is arranged between side walls 35, 36 and is fastened thereto. The side walls 35, 36 are connected to one another by three crossbars 40. Conveyor belts 20, 21, 22 guided via rolls 44, 45 46 and deflector plates 47, 48, 49 of the units 13, 14, 15 of the conveyor mechanism, are arranged between side walls 29, 30 and 33 to 36 connected to one another by crossbars 37, 39, 40. Each of the conveyor belts 20, 21, 22 is driven by electrical drives not illustrated and known per se, for example geared motors, driving the guide rolls 44–46 over which the conveyor belts are guided.

Arranged at the lower ends of the side walls 29–36 are runners 25–28, by means of which the units 13, 14 of the conveyor mechanism, the printing unit 41 and the device 12 with the tunnel dryer 42 and the unit 15 of the conveyor mechanism are mounted movably on rails 23, 24. The rails can be arranged in a way known per se in or on the floor at the place of erection of the apparatus. The above-mentioned units 13, 14, the printing unit 41 and the device 12 are movable in and oppositely to the conveying direction (arrow 19) of the conveyor mechanism. The operation can be carried out manually or mechanically. Mechanically it is carried out by driving the runners 25–28 or else by thrust elements, e.g. working cylinders actuable by a pressure medium. These drives are, however, not illustrated in the drawings. The electrical devices of the units 13, 14 of the conveyor mechanism, of the printing unit 41 and of the heat treatment device 12 are interconnected by flexible electrical leads 56, 57, 58 and are linked to an electrical control system 59. Plug couplings 60 are fitted in the electrical leads 56, 57, 58 for the rapid disconnection thereof. The positions of the plug couplings 60 and of the control system 59 may, of course, be different from those shown in FIG. 2.

Figure 3:
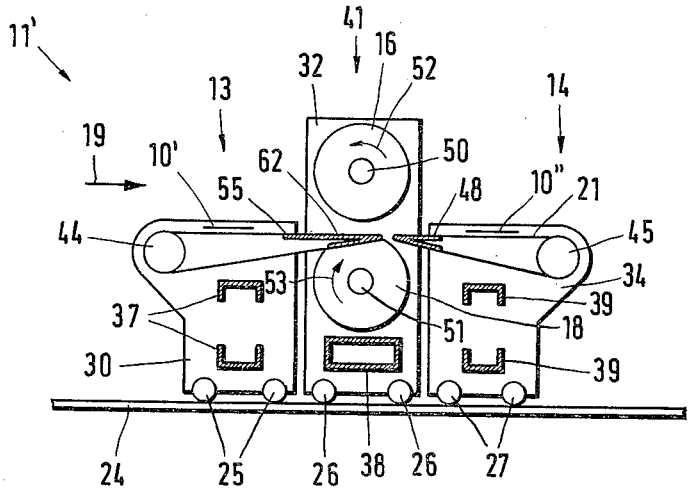
FIG. 3 is a longitudinal section through a coating device in which the working range of the printing unit is smaller than the working width of the conveyor mechanism, along the sectional line in FIG. 4.
Figure 4:
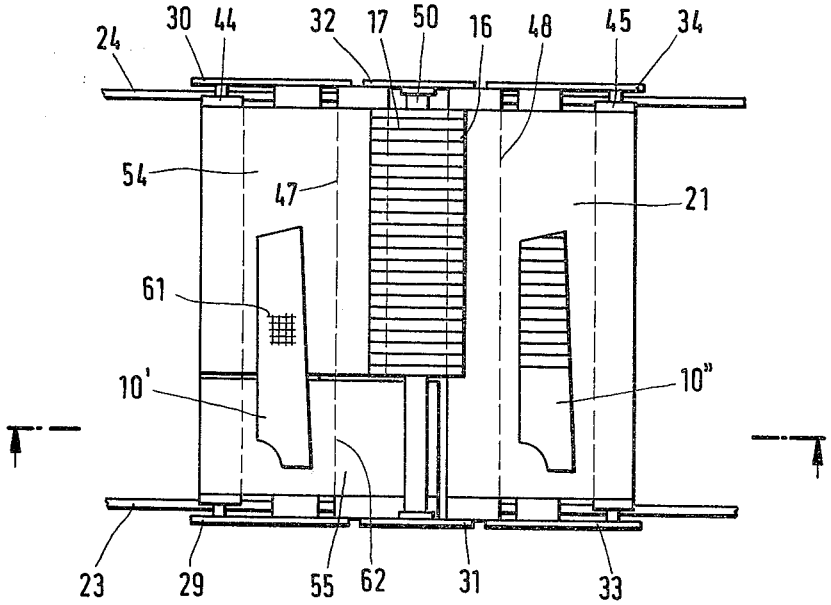
FIG. 4 is a plan view of FIG. 3.

In the case of the coating device 11' illustrated in FIGS. 3 and 4, with a printing unit 41 whose working range is smaller than the working width of the conveyor mechanism, the latter is likewise subdivided into two units 13, 14. However, in contrast to that shown in FIGS. 1 and 2, the unit 13 has two conveyor belts 54, 55 arranged next to one another. The first conveyor belt 54 has a width corresponding to the length of the printing cylinder 15 or of the pressure roller 18. The second conveyor belt 55 has a width corresponding to the difference between the length of the printing cylinder 16 or pressure roller 18 and the working width of the conveyor mechanism. The first conveyor belt 54 is guided in the same way as the conveyor belt 20 (FIG. 1). The second conveyor belt 55 is guided in the conveying direction to immediately in front of the conveyor belt 21 of the unit 14 of the conveyor mechanism. Further, both conveyor belts 54, 55 are guided on the feed side over the guide roll 44, by means of which they are also driven at the same speed. In the region of the printing unit 41 the conveyor belts 54, 55 are guided over the deflector plates 47 (conveyor belt 54) and 62 (conveyor belt 55). Due to this construction of the unit 13, textile sheets 10′ which are to be coated only partly, in a line pattern in the weft direction 61 of their fabric, (see item 10″), are conveyed supported both in the coating region and in the non-coating region.

The lateral movability of the printing unit 41 may also be provided for, analogously to the foregoing, especially in cases where the apparatus cannot be moved far enough apart longitudinally owing to the conditions present at its place of erection. Because of such conditions it may also be advantageous to move the heat treatment device 12, although this is not normally necessary.

The apparatus has all other parts and devices required for the operation thereof according to the invention and for coating textile sheets 10 and 10′, for example adjusting plug couplings for the precise and rapid coupling and uncoupling of the detachable units and devices. However, these parts and devices are not illustrated in the drawings, because they are known. The mode of operation of the apparatus for the coating of textile sheets is also known.

What is claimed is:

1. Apparatus for the stiffening of textile sheets of various shapes for the manufacture of garments by coating with plastic, especially for the stiffening of such sheets for outer fabrics, said apparatus including a device for the coating of the textile sheets and a device for the subsequent heat treatment thereof, and a belt-shaped conveyor mechanism for the conveying of the textile sheets through said device, the coating device having a printing unit with a printing cylinder arranged above a pressure roller and the heat treatment device having a tunnel drier, the operating range of said printing unit being smaller than the operating width of said conveyor mechanism and said printing cylinder and said pressure roller being vertically arranged without a conveyor belt therebetween, the improvement wherein said conveyor mechanism is divided into at least first and second movable units couplable to said printing unit across the entire operating width in the area of said coating device transversely to a conveying direction of textile sheets in said conveyor mechanism, said first movable unit being arranged in front of said printing unit and having a first conveyor belt with a width corresponding to the length of said printing cylinder and a second conveyor belt longer than said first conveyor belt and having a width corresponding to the difference between the length of said printing cylinder and the operating width of said conveyor mechanism, said second movable unit having a third conveyor belt, said second conveyor belt leading in said conveying direction directly to said third conveyor belt, and said second movable unit being as wide as the sum of the widths of said first conveyor belt and said second conveyor belt.

2. The apparatus according to claim 1, wherein said printing unit is also movable.

3. The apparatus according to claim 1 or 2, wherein said movable units of said conveyor mechanism and said printing unit are movable in and opposite to said conveying direction of said conveyor mechanism.

4. The apparatus according to claim 2, wherein said printing unit is movable parallel to said conveying direction.

5. The apparatus according to claim 1 or 2, wherein at least one of said movable units and said printing unit are movably mounted on rails.

6. The apparatus according to claim 1 or 2, wherein said movable units and said printing unit are mechanically movable by driving rollers.

7. The apparatus according to claim 1 or 2 wherein said movable units and said printing unit are mechanically movable by thrust elements.

8. The apparatus according to claim 1 or 2 wherein said movable units and said printing unit are mechanically movable by thrust elements operable by a pressure medium.

9. The apparatus according to claim 1 or 2, wherein electric systems of said movable units of said printing unit and of said heat treatment device are connected with each other and with a control system by means of flexible electric lines and wherein said electric lines are separable by means of plug contacts arranged in said electric lines.

* * * * *